US005387060A

United States Patent [19]

Locotos

[11] Patent Number: 5,387,060

[45] Date of Patent: Feb. 7, 1995

[54] TUBULAR MINING BOLT

[75] Inventor: Frank M. Locotos, McMurray, Pa.

[73] Assignee: F. M. Locotos Equipment & Design Co., Bridgeville, Pa.

[21] Appl. No.: 37,812

[22] Filed: Mar. 26, 1993

[51] Int. Cl.[6] ..... E21D 21/00; E21D 20/00

[52] U.S. Cl. ..... 405/259.6; 405/259.3; 411/61

[58] Field of Search ..... 405/259.3, 259.6, 259.5, 405/259.1; 411/57-62, 513, 521, 16-24, 32, 33, 544, 55, 56, 545

[56] References Cited

U.S. PATENT DOCUMENTS

| | | | |
|---|---|---|---|
| 3,797,254 | 3/1974 | Askey et al. | 405/259.3 |
| 4,126,004 | 11/1978 | Lindeboom | 405/259.1 |
| 4,316,677 | 2/1982 | CiaVatta | 405/259.1 |
| 4,350,462 | 9/1982 | Elders | 405/259.3 |
| 4,407,610 | 10/1983 | Elders | 405/259.3 |
| 4,430,025 | 2/1984 | CiaVatta | 405/259.6 |
| 4,502,818 | 3/1985 | Elders | 405/259.3 |
| 4,664,555 | 5/1987 | Herbst | 405/259.5 |

FOREIGN PATENT DOCUMENTS

| | | | |
|---|---|---|---|
| 2555527 | 1/1977 | Germany | 405/259.6 |
| 2059535 | 1/1981 | United Kingdom | 405/259.6 |
| 2095308 | 9/1982 | United Kingdom | 405/259.6 |
| 1446327 | 12/1988 | U.S.S.R. | 405/259.6 |

*Primary Examiner*—Dennis L. Taylor
*Attorney, Agent, or Firm*—Ansel M. Schwartz

[57] ABSTRACT

The present invention is a system for supporting rock within a mine having a bore hole. The system comprises a mining bolt having a round metal tube which has a completely hollow interior and all cross sectional dimensions less than that of the bore hole. The metal tube has a first end and a second end which are swaged closed to permanently close off the completely hollow interior so the bolt can crush and deform during movement of the rock when in place therein. The swaged second end has a square cross section to allow a tool to turn the mining bolt in the bore hole from the second end. The mining bolt has a metal washer flange fixedly attached to the metal tube adjacent to the swaged second end. The system also comprises a bearing plate disposed between the rock and the flange and a resin cartridge for bonding the mining bolt to the rock within the bore hole. The metal tube has spiral ribbing disposed on the outer surface to mix resin from the resin cartridge as the mining bolt is turned in the bore hole from the swaged second end.

2 Claims, 3 Drawing Sheets

TUBULAR MINING BOLT

FIELD OF THE INVENTION

The present invention is related to mine roof supports. More specifically, the present invention is related to a mining bolt which has a hollow interior.

BACKGROUND OF THE INVENTION

It is a well established practice in underground mining work, such as coal mining, tunnel excavation, or the like, to reinforce the roof of the mine to prevent its collapse. There are various types of reinforcement apparatus, the most common are of the mining bolt type. These mining bolts are of various designs.

A problem exists with conventional mining bolts in that after installation, conventional mining bolts will often tear loose or shear due to blasts or natural rock shifts. This could lead to a catastrophe such as a cave-in. Accordingly, several attempts have been made in the prior art to produce a mining bolt that resists shear.

Split-Set ® by Ingersoll-Rand is a mining bolt which is comprised of a c-shaped metal member which is forced into a bore hole and supports the rock by friction. The hollow shape of the Split-Set ® bolt allows the bolt to deform rather than break when a rock shift occurs. Unfortunately, the c-shape is not a conventional shape and thus is costly to manufacture.

Swellex ® by Atlas Copco, Inc. of Sweden is a hollow folded c-shaped tube which expands in the bore hole by means of high pressure water. During the swelling process, the Swellex ® bolt adapts to fit the irregularities of the bore hole. The hollow shape allows the tube to deform during rock shifts. Unfortunately, the complex shape of the Swellex ® mining bolt is expensive to manufacture. Further, the necessary high pressure water tools and fittings add to the expense and complexity of the method.

Spin-Lock ® by Williams Co. discloses a rock bolt which has a hollow interior and has open ends for allowing grout to be pumped therethrough. No resin cartridges are disclosed.

The present invention describes a mining bolt which can be made from inexpensive, stock round tubing. The hollow interior of the tubing allows the mining bolt of the present invention to deform during rock shifts instead of break. Further, the hollow mining bolt of the present invention saves steel as compared with a solid mining bolt of equal strength.

SUMMARY OF THE INVENTION

The present invention pertains to a system for supporting rock within a mine. The system comprises a mining bolt which has a hollow interior. The system also comprises a resin cartridge for bonding the mining bolt to the rock within a bore hole. As is well known in the art, the resin cartridge can be punctured by the mining bolt during insertion. Preferably, the mining bolt has swaged end portions which close off the hollow interior. Preferably, there is also a flange at the second end of the mining bolt. A bearing plate can be disposed between the flange and the rock. It should be appreciated that a mining bolt formed from stock metal tubing is extremely inexpensive to manufacture and uses less metal than compared to conventional solid mining bolts of equal strength. Even more critical is the fact that the hollow interior of the mining bolt allows it to crush and deform rather than break, during rock movements, due to natural geological shifts or blasting.

The present invention is also a method of supporting rock within a mine. The method comprises the step of drilling a bore hole into the rock. The method also comprises the steps of placing a resin cartridge within the bore hole and inserting a hollow mining bolt into the bore hole.

Preferably, the drilling step includes the step of drilling a bore hole having a first diameter. The hollow mining bolt has a second diameter which is less than the first diameter. Preferably, the inserting step includes the step of inserting a hollow mining bolt having a bearing plate at one end into the bore hole such that the bearing plate abuts against the rock face. Preferably, the inserting step includes the steps of puncturing the resin cartridge and spinning the hollow mining bolt to mix the resin in the resin cartridge.

The present invention is also a method of forming a mining bolt which comprises the steps of squeezing a first end of a round metal tube closed and forming a flange on the second end of the round metal tube. Preferably, after the first squeezing step, there is the step of squeezing a second end of the metal tube closed such that the second end forms a square swaged end portion. Preferably, the forming step includes the step of crimping a metal flange to the second end of the round metal tube.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
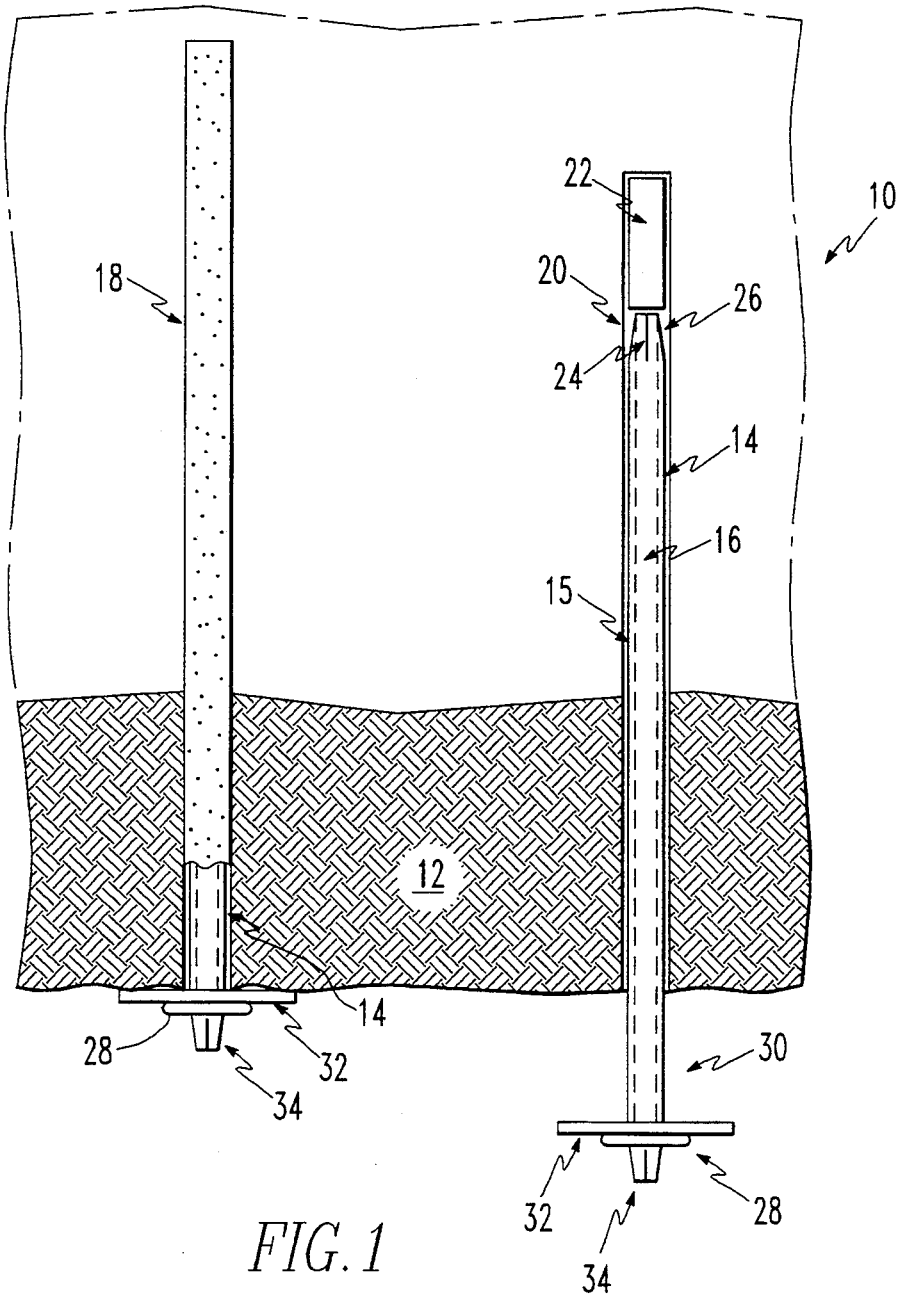
FIG. 1 is a schematic representation showing the system for support rock within a mine.

Referring now to the drawings wherein like reference numerals refer to similar or identical parts throughout the several views, and more specifically to FIG. 1 thereof, there is shown a system 10 for supporting rock 12 within a mine. The system 10 comprises a mining bolt 14 which has a hollow interior 16 (as represented by the dotted lines). The system 10 also comprises a resin cartridge 22 having resin 18 for bonding the mining bolt 14 to the rock 12 within a bore hole 20. As is well known in the art, the resin cartridge 22 is punctured by the mining bolt 14 during insertion.

Preferably, the mining bolt 14 has a swaged end portion 24 at a first end 26 which closes off the hollow interior 16. Preferably, there is also a flange 28 at the second end 30 of the mining bolt 14. Further, a bearing plate 32 can be disposed between the flange 28 and the rock 12.

Preferably, the mining bolt 14 is comprised of stock round metal tubing 15 which is swaged closed at each end 26, 30. In this manner, the hollow interior 16 is sealed from the bore hole 20 and thus resin 18 cannot enter the hollow interior 16. The flange 28 can be a metal washer which is crimped onto the second end 30 of the metal tubing 15. Preferably, the metal tubing 15 is comprised of steel so a material to prevent corrosion is necessary to coat the steel since the resin surrounds the steel and prevents corrosion.

Figure 2:
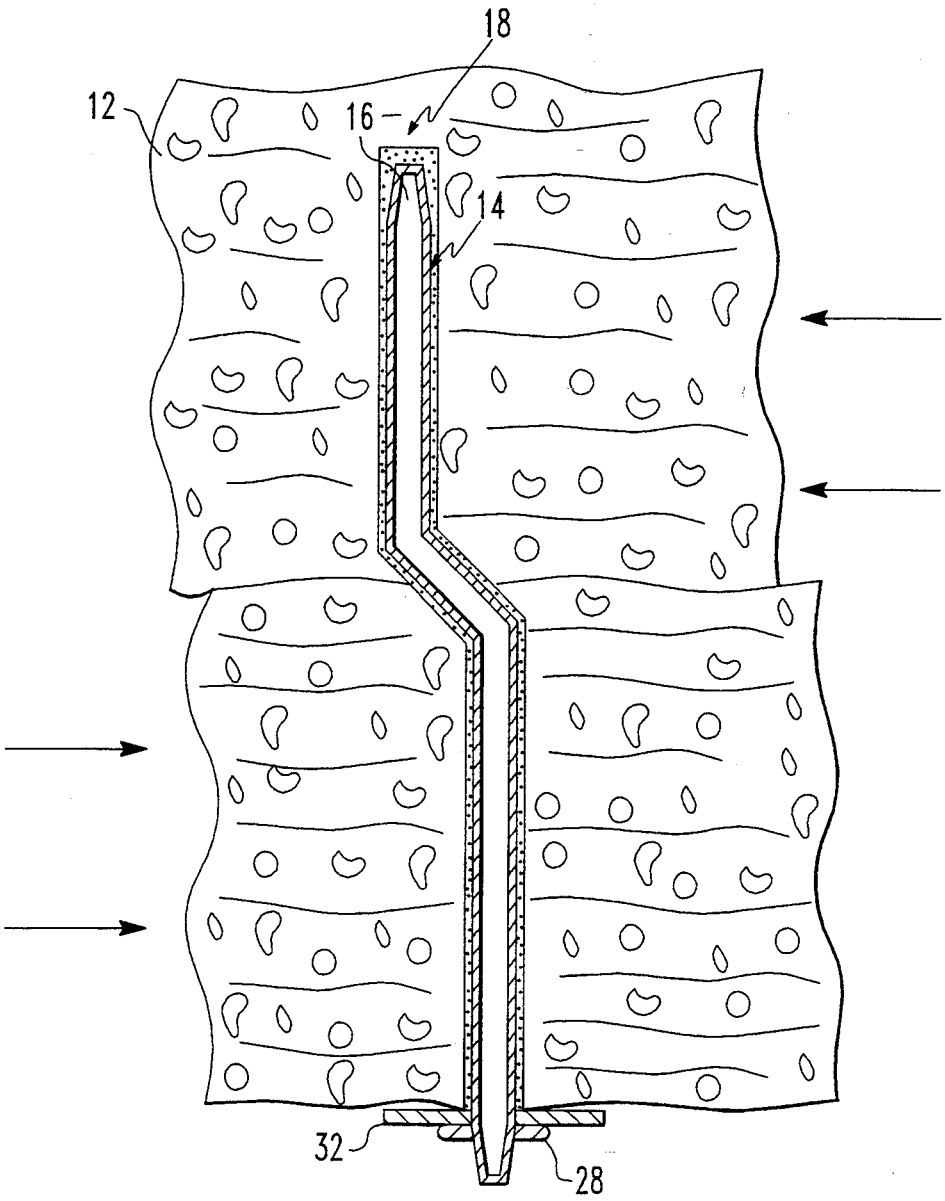
FIG. 2 is a schematic representation showing the hollow mining bolt being deformed due to shifting of the rock.

It should be appreciated that a mining bolt 14 formed from stock metal tubing is extremely inexpensive to manufacture and uses less metal than compared to conventional solid mining bolts of equal strength. Even more critical is the fact that the hollow interior 16 of the mining bolt 14, as shown in FIG. 2, allows it to crush and deform rather than break, during rock movements, due to natural geological shifts or blasting. Thus, the mining bolt 14 of the present invention could support the rock 12 during situations when conventional solid mining bolts would break, thereby preventing a catastrophe such as cave-in.

In a preferred embodiment, there is a swaged end portion 34 at the second end 30 which has a square cross section for allowing the mining bolt 14 to be turned through the resin 18 for mixing. If desired, as shown in FIG. 3, there can be mixing means, such as spiral ribbing 36, disposed on the mining bolt 14, for mixing the resin 18 in the bore hole 20.

Figure 3:
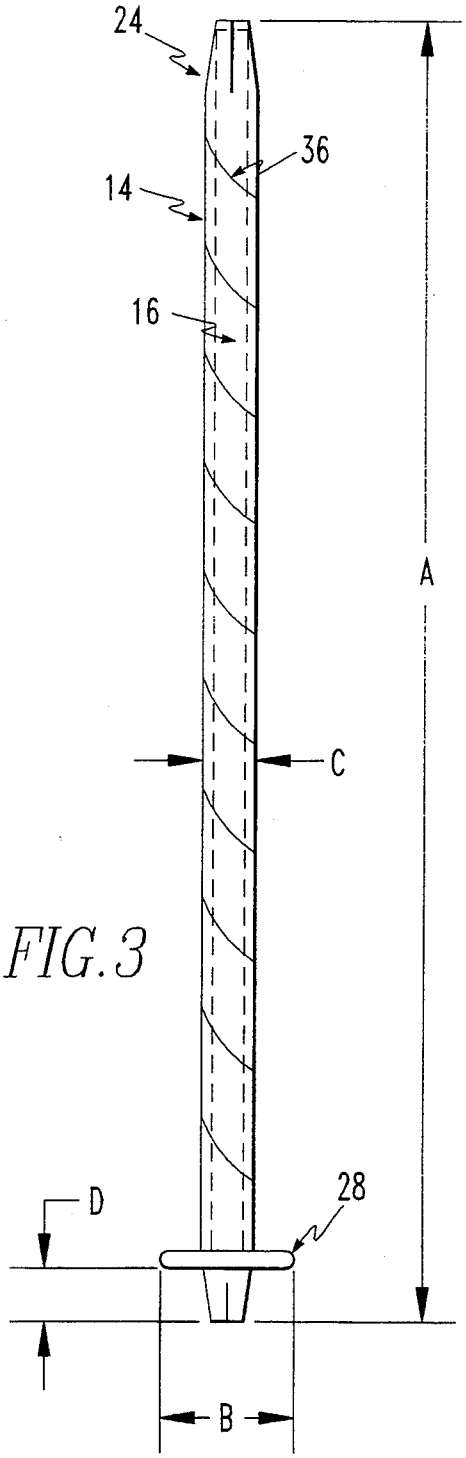
FIG. 3 is a schematic representation showing one embodiment of the mining bolt.
Figure 4:
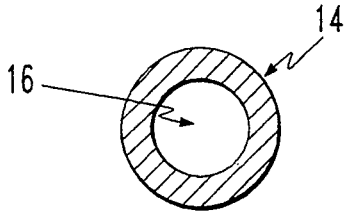
FIG. 4 is a schematic representation showing the closed circular cross section of the mining bolt.

The dimensions of the mining bolt 14, as represented by the reference numerals in FIG. 3, preferably fall within the following range, but are not limited thereto.

A 2'–20'
B 2"–4"
C $\frac{3}{4}$"–3"
D $\frac{3}{4}$"–2"

The present invention is also a method of supporting rock 12 within a mine. The method comprises the step of drilling a bore hole 20 into the rock 12. The method also comprises the steps of placing a resin cartridge 22 within the bore hole 20 and inserting a hollow mining bolt 14 into the bore hole 20. Preferably, the drilling step includes the step of drilling a bore hole having a first diameter. The hollow mining bolt 14 has a second diameter which is less than the first diameter. Preferably, the inserting step includes the step of inserting a hollow mining bolt 14 having a bearing plate 32 at one end into the bore hole 20 such that the bearing plate 32 abuts against the rock 12. Preferably, the inserting step includes the steps of puncturing the resin cartridge 22 and spinning the hollow mining bolt 14 to mix the resin 18 in the resin cartridge 22.

The present invention is also a method of forming a mining bolt 14 which comprises the steps of squeezing a first end 26 of a round metal tube 15 closed and forming a flange 28 on the second end 30 of the round metal tube. Preferably, after the first squeezing step, there is the step of squeezing a second end of the metal tube 15 closed such that the second end forms a square swaged end portion 34. Preferably, the flange 28 is crimped onto the second end 30 of the round metal tube 15, such as with a crimping machine manufactured by George Mitchel Company of Youngstown, Ohio. Alternatively, the forming step can include the step of welding a metal flange 28 to the second end 30 of the round metal tube 15.

In the operation of the preferred embodiment, a bore hole 20 having a length of 6'2" and a diameter of $1\frac{3}{8}$" is drilled into the rock 12. Next, a resin cartridge 22 having H-resin within is inserted into the bore hole 20. A hollow mining bolt 14 having a bearing plate 32 resting on a flange 28 is then inserted into the bore hole 20. The mining bolt 14 is comprised of steel tubing 15 which is swaged closed at each end. The tubing 15 has an outside diameter of $1\frac{1}{4}$" and is 16 gauge. The flange 28 has a 2" O.D. and is designed to hold a bearing plate 32. Preferably, the flange 28 holds a load of about 20,000 pounds. As the mining bolt 14 is pushed into the bore hole 20, the swaged end portion 24 punctures the resin cartridge 22. The resin 18 flows between the mining bolt 14 and the bore hole 20. The mining bolt 14 is turned at the square end 34 to mix the resin 18 and is pushed into the bore hole 20 until the bearing plate 32 abuts against the face of the rock 12. The mining bolt 14 is held in place (about 20 seconds) until the resin 18 solidifies to bond the mining bolt 14 to the rock within the bore hole 20. At this point, the mining bolt 14 is capable of supporting the rock. If a geological rock-shift occurs across the mining bolt 14, the hollow interior 16 of the mining bolt 14 allows the mining bolt 14 to crush and deform, as shown in FIG. 2, rather than break.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for supporting rock within a mine having a bore hole comprising:

a mining bolt having a round metal tube which has a completely hollow interior and all cross sectional dimensions less than that of the bore hole, said metal tube having a first end and a second end which are swaged closed to permanently close off the completely hollow interior so the bolt can crush and deform during movement of the rock when in place therein, said swaged second end having a square cross section to allow a tool to turn the mining bolt in the bore hole from the second end, said mining bolt having a metal washer flange fixedly attached to the metal tube adjacent to the swaged second end;

a bearing plate disposed between the rock and the flange; and a resin cartridge for bonding the mining bolt to the rock within a bore hole, said metal tube having spiral ribbing disposed on the outer surface to mix resin from the resin cartridge as the mining bolt is turned in the bore hole from the swaged second end.

2. A system as described in claim 1 wherein the mining bolt has an outer diameter between $\frac{1}{2}$" and 3" and a length between 2' and 20'.

* * * * *